US009753426B2

(12) United States Patent
Komito et al.

(10) Patent No.: US 9,753,426 B2
(45) Date of Patent: Sep. 5, 2017

(54) IMAGE BEARER PROTECTIVE AGENT, PROTECTIVE LAYER FORMING DEVICE, IMAGE FORMING METHOD, IMAGE FORMING APPARATUS, AND PROCESS CARTRIDGE

(71) Applicants: Kenji Komito, Tokyo (JP); Hiroshi Nakai, Kanagawa (JP); Kohsuke Yamamoto, Osaka (JP); Hiroshi Mizusawa, Tokyo (JP); Sho Akiyama, Tokyo (JP)

(72) Inventors: Kenji Komito, Tokyo (JP); Hiroshi Nakai, Kanagawa (JP); Kohsuke Yamamoto, Osaka (JP); Hiroshi Mizusawa, Tokyo (JP); Sho Akiyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/270,811

(22) Filed: Sep. 20, 2016

(65) Prior Publication Data

US 2017/0090399 A1 Mar. 30, 2017

(30) Foreign Application Priority Data

Sep. 30, 2015 (JP) ..... 2015-194274
Jan. 5, 2016 (JP) ..... 2016-000662

(51) Int. Cl.

| | |
|---|---|
| ***G03G 21/00*** | (2006.01) |
| ***C10M 129/40*** | (2006.01) |
| ***C10M 125/20*** | (2006.01) |

(52) U.S. Cl.

CPC ..... *G03G 21/0094* (2013.01); *C10M 125/20* (2013.01); *C10M 129/40* (2013.01); *C10M 2201/087* (2013.01); *C10M 2207/126* (2013.01); *C10N 2240/203* (2013.01)

(58) Field of Classification Search

CPC ..... G03G 21/0094; C10M 125/20; C10M 129/40
USPC ..... 399/346
See application file for complete search history.

(56) References Cited

U.S. PATENT DOCUMENTS

| | | | | |
|---|---|---|---|---|
| 7,941,087 | B2 * | 5/2011 | Tanaka et al. | G03G 21/0094 399/346 |
| 9,217,985 | B2 * | 12/2015 | Komito et al. | G03G 21/0094 |
| 9,513,594 | B2 * | 12/2016 | Hasegawa et al. | G03G 21/0094 |
| 9,632,475 | B2 * | 4/2017 | Uenishi et al. | G03G 21/0094 |
| 2005/0164108 | A1 | 7/2005 | Murakami et al. | |
| 2006/0285897 | A1 | 12/2006 | Sugiura et al. | |
| 2007/0123435 | A1 | 5/2007 | Usami | |
| 2007/0224528 | A1 | 9/2007 | Yamashita et al. | |
| 2007/0242992 | A1 | 10/2007 | Watanabe et al. | |

(Continued)

FOREIGN PATENT DOCUMENTS

| | | |
|---|---|---|
| JP | 2005-171107 | 6/2005 |
| JP | 2006-350240 | 12/2006 |

(Continued)

*Primary Examiner* — William J Royer
(74) *Attorney, Agent, or Firm* — Oblon, McClelland, Maier & Neustadt, L.L.P.

(57) ABSTRACT

An image bearer protective agent is provided. The image bearer protective agent includes a fatty acid metal salt and an inorganic lubricant. The inorganic lubricant includes a first inorganic lubricant having a tap density of from 0.30 to 0.8 g/cm$^2$.

16 Claims, 4 Drawing Sheets

(56) References Cited

U.S. PATENT DOCUMENTS

| | | | |
|---|---|---|---|
| 2008/0118286 | A1 | 5/2008 | Yamashita et al. |
| 2009/0196665 | A1 | 8/2009 | Tanaka et al. |
| 2009/0279930 | A1 | 11/2009 | Kabata et al. |
| 2009/0285613 | A1 | 11/2009 | Nakai et al. |
| 2009/0290919 | A1 | 11/2009 | Tanaka et al. |
| 2009/0311014 | A1 | 12/2009 | Tanaka et al. |
| 2010/0034560 | A1 | 2/2010 | Tanaka et al. |
| 2010/0183972 | A1 | 7/2010 | Hasegawa et al. |
| 2010/0209143 | A1 | 8/2010 | Nakai et al. |
| 2010/0239309 | A1 | 9/2010 | Tanaka et al. |
| 2010/0310291 | A1 | 12/2010 | Tanaka et al. |
| 2011/0008088 | A1 | 1/2011 | Nakai et al. |
| 2011/0038656 | A1 | 2/2011 | Hasegawa et al. |
| 2011/0052286 | A1 | 3/2011 | Urayama et al. |
| 2011/0085824 | A1 | 4/2011 | Hatakeyama et al. |
| 2011/0129269 | A1 | 6/2011 | Seo et al. |
| 2011/0129270 | A1 | 6/2011 | Seo et al. |
| 2012/0057912 | A1 | 3/2012 | Hasegawa et al. |
| 2012/0060753 | A1 | 3/2012 | Tanaka et al. |
| 2012/0063809 | A1 | 3/2012 | Tanaka et al. |
| 2012/0063825 | A1 | 3/2012 | Hasegawa et al. |
| 2012/0195662 | A1 | 8/2012 | Hasegawa et al. |
| 2013/0216286 | A1 | 8/2013 | Hasegawa et al. |
| 2013/0259552 | A1 | 10/2013 | Hasegawa et al. |
| 2013/0315642 | A1 | 11/2013 | Nakai et al. |
| 2014/0030644 | A1 | 1/2014 | Hasegawa et al. |
| 2014/0093294 | A1 | 4/2014 | Komito et al. |

FOREIGN PATENT DOCUMENTS

| | | |
|---|---|---|
| JP | 2007-145993 | 6/2007 |
| JP | 2009-186610 | 8/2009 |
| JP | 2009-282160 | 12/2009 |
| JP | 2009-288728 | 12/2009 |
| JP | 2009-300861 | 12/2009 |
| JP | 2010-039304 | 2/2010 |
| JP | 2012-058539 | 3/2012 |
| JP | 2014-074762 | 4/2014 |
| JP | 2014-142538 | 8/2014 |

* cited by examiner

IMAGE BEARER PROTECTIVE AGENT, PROTECTIVE LAYER FORMING DEVICE, IMAGE FORMING METHOD, IMAGE FORMING APPARATUS, AND PROCESS CARTRIDGE

CROSS-REFERENCE TO RELATED APPLICATIONS

This patent application is based on and claims priority pursuant to 35 U.S.C. §119(a) to Japanese Patent Application Nos. 2015-194274 and 2016-000662, filed on Sep. 30, 2015 and Jan. 5, 2016, respectively, in the Japan Patent Office, the entire disclosure of each of which is hereby incorporated by reference herein.

BACKGROUND

Technical Field

The present disclosure relates to an image bearer protective agent, a protective layer forming device, an image forming method, an image forming apparatus, and a process cartridge.

Description of the Related Art

In electrophotography, an electrostatic latent image is formed on an image bearer, and the electrostatic latent image is developed with charged toner to become a visible image. The visible image is transferred onto a recording medium.

After the visible image has been transferred from the image bearer onto a recording medium (this process may be hereinafter referred to as "transfer process"), some toner particles may remain on the image bearer without being transferred. When a new electrostatic latent image is formed on the image bearer with such residual toner particles remaining thereon, the image bearer is prevented from being uniformly charged. Therefore, residual toner particles are generally removed from the image bearer in a process called cleaning process after the transfer process. In attempting to prevent toner particles from remaining on the image bearer after the transfer process, applying an image bearer protective agent which contains a fatty acid metal salt and an inorganic lubricant (e.g., boron nitride) to the surface of the image bearer has been proposed.

SUMMARY

In accordance with some embodiments of the present invention, an image bearer protective agent is provided. The image bearer protective agent includes a fatty acid metal salt and an inorganic lubricant. The inorganic lubricant includes a first inorganic lubricant having a tap density of from 0.30 to 0.8 g/cm$^2$.

In accordance with some embodiments of the present invention, a protective layer forming device is provided. The protective layer forming device includes the above image bearer protective agent and an image bearer protective agent supply member. The image bearer protective agent supply member supplies the image bearer protective agent onto a surface of an image bearer.

In accordance with some embodiments of the present invention, an image forming method is provided. The image forming method includes the processes of forming an electrostatic latent image on an image bearer, developing the electrostatic latent image with toner to form a visible image, transferring the visible image onto a recording medium, supplying the above image bearer protective agent onto a surface of the image bearer after the visible image has been transferred therefrom, and forming the image bearer protective agent into a protective layer.

In accordance with some embodiments of the present invention, an image forming apparatus is provided. The image forming apparatus includes an image bearer, an electrostatic latent image forming device, a developing device, a transfer device, and the above protective layer forming device. The electrostatic latent image forming device forms an electrostatic latent image on the image bearer. The developing device develops the electrostatic latent image with toner to form a visible image. The transfer device transfers the visible image onto a recording medium. The protective layer forming device supplies the image bearer protective agent onto a surface of the image bearer after the visible image has been transferred therefrom, to form the image bearer protective agent into a protective layer.

In accordance with some embodiments of the present invention, a process cartridge is provided. The process cartridge includes an image bearer and the above protective layer forming device that supplies the image bearer protective agent onto a surface of the image bearer and form the image bearer protective agent into a protective layer

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
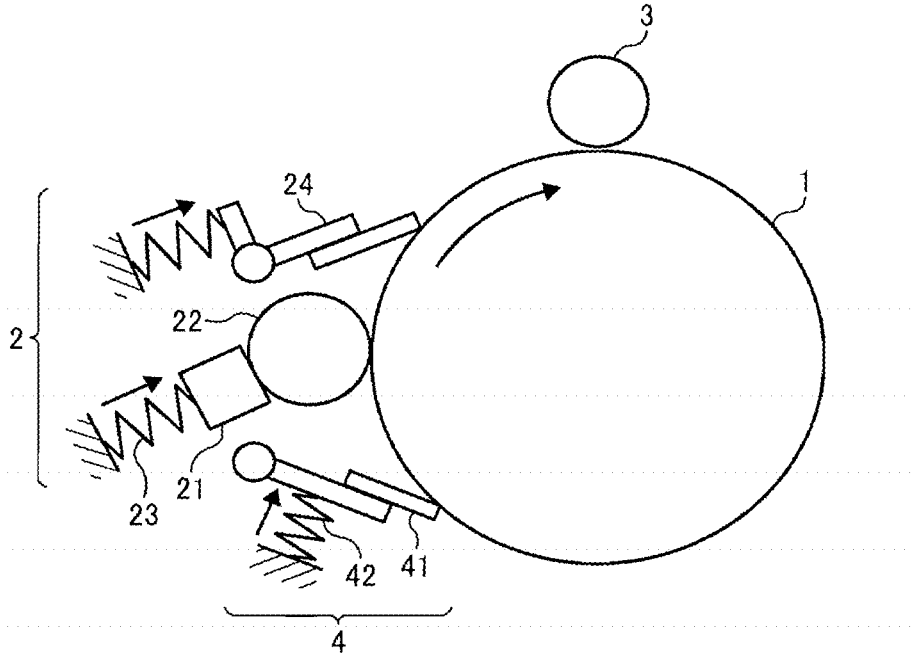
FIG. 1 is a schematic view of a protective layer forming device according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

In accordance with some embodiment of the present invention, an image bearer protective agent is provided which has a good combination of moldability, image bearer protection performance, charger contamination prevention performance, and cleaning ability.

Image Bearer Protective Agent

An image bearer protective agent according to an embodiment of the present invention includes a fatty acid metal salt and an inorganic lubricant. The inorganic lubricant includes a first inorganic lubricant having a tap density of from 0.30 to 0.8 g/cm$^2$. The image bearer protective agent may optionally include other components, if necessary.

The present invention is provided based on a finding by the inventors of the present invention that a related-art image bearer protective agent which includes a fatty acid metal salt and boron nitride as an inorganic lubricant cannot achieve a good combination of moldability, image bearer protection performance, charger contamination prevention performance, and cleaning ability, even when the boron nitride is adjusted in various physical properties, such as average particle diameter, secondary particle diameter, and oxygen content. The present invention is also provided based on another finding by the inventors of the present invention that, in the cleaning process, as a cleaning blade or an application blade is rubbed against the image bearer, the blade causes a vibration along with an abnormal noise. This abnormal noise is hereinafter called "blade squeaking".

Fatty Acid Metal Salt

Specific examples of usable fatty acid metal salts include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate, zinc laurate, cobalt laurate, lead laurate, and magnesium laurate. Each of these compounds can be used alone or in combination with others. Among these compounds, zinc stearate, calcium stearate, and zinc laurate are preferable. They provide excellent cleaning ability and image bearer protection performance while being available at low cost. In addition, they are very stable substances with high hydrophobicity. In particular, zinc stearate is most preferable.

The fatty acid metal salt may take any structure, such as a lamellar crystal structure.

The content rate of the fatty acid metal salt in the image bearer protective agent is preferably from 70% to 98% by mass, more preferably from 75% to 95% by mass. When the content rate is in the range of from 70% to 98% by mass, the image bearer protective agent can achieve an excellent combination of image bearer protection performance, charger contamination prevention performance, cleaning ability, and moldability.

Inorganic Lubricant

The inorganic lubricant is defined as a compound which cleaves by itself, to lubricate by itself or to cause an inner sliding.

Preferably, the inorganic lubricant further includes a second inorganic lubricant other than the first inorganic lubricant.

Specific examples of the inorganic lubricant (the first inorganic lubricant and the second inorganic lubricant) include, but are not limited to, mica, boron nitride, molybdenum disulfide, tungsten disulfide, talc, kaolin, montmorillonite, calcium fluoride, silica, graphite, polymethyl methacrylate (PMMA) resin, polytetrafluoroethylene (PTFE) resin, melamine formaldehyde, organic molybdenum, and silicone resin. Each of these compounds can be used alone or in combination with others. Among these compounds, boron nitride and mica are preferably used as the first inorganic lubricant. In particular, boron nitride is more preferable. Boron nitride has a layered structure in which hexagonal network planes formed of strongly-bonded atoms are overlaid on one another at wide intervals. Since the layers of the hexagonal network planes are just bonded with weak van der Waals' force, the layers can be easily cleaved from each other, thus making boron nitride itself capable of lubricating.

The first inorganic lubricant preferably has a tap density of from 0.30 to 0.8 g/cm$^3$, more preferably from 0.30 to 0.7 g/cm$^3$, and most preferably from 0.35 to 0.6 g/cm$^3$. When the tap density is 0.30 g/cm$^3$ or more, the first inorganic lubricant provides good powder fluidity, which improves image bearer protection performance, cleaning ability, charger contamination prevention performance, and moldability of the image bearer protective agent. When the tap density is 0.8 g/cm$^3$ or less, the first inorganic lubricant is unlikely to accumulate on the image bearer, although the powder fluidity is high, thus improving image bearer protection performance. When the tap density of the first inorganic lubricant is within the above-described preferable range, the powder fluidity and film forming property of the image bearer protective agent are adjusted to a proper level. Thus, a good combination of image bearer protection performance, cleaning ability, charger contamination prevention performance, and moldability can be achieved.

The second inorganic lubricant preferably has a tap density of 0.25 g/cm$^3$ or less, more preferably from 0.15 to 0.25 g/cm$^3$, and most preferably from 0.2 to 0.25 g/cm$^3$. When the tap density is 0.25 g/cm$^3$ or less, the second inorganic lubricant exerts low fluidity and strong aggregation property. As such particles of the second inorganic lubricant accumulate on the blade edge, the blade behavior becomes stabilized while the occurrence of blade squeaking is prevented.

The combined use of the first inorganic lubricant and the second inorganic lubricant provides high film forming efficiency and lubricity and prevents the occurrence of blade squeaking.

The tap density can be measured with a powder characteristics tester (POWDER TESTER PT-X, product of Hosokawa Micron Corporation) using a glass measuring cylinder, in accordance with Japanese Pharmacopoeia or United States Pharmacopoeia.

The inorganic lubricant preferably has a number average primary particle diameter of from 0.1 to 10 μm. When the number average primary particle diameter of the inorganic lubricant is within this preferable range, cleaning ability and image bearer protection performance are improved.

The number average primary particle diameter of the inorganic lubricant can be determined by observing ten particles of the inorganic lubricant with a scanning electron microscope (thermal F-SEM ULTRA 55, product of Carl Zeiss AG), measuring the diameter of each particle in the observed image with image analysis and measurement software (Image-Pro Plus 4.0j, product of Media Cybernetics), and averaging the ten measured diameter values.

As the first inorganic lubricant, the following commercially available products having a tap density of from 0.30 to 0.8 g/cm$^3$ can be used: HP-2W (boron nitride having a tap density of 0.3 g/cm$^3$, available from Mizushima Ferroalloy Co., Ltd.); PCTP5, PCTP8, and PCTL30 (boron nitrides having a tap density of 0.3, 0.5, and 0.6 g/cm$^3$, respectively, available from Saint-Gobain K.K.); MGP (boron nitride having a tap density of 0.8 g/cm$^3$, available from Denka Company Limited); and HP-1CAW (boron nitride having a tap density of 0.8 g/cm$^3$, available from Mizushima Ferroalloy Co., Ltd.). Each of these compounds can be used alone or in combination with others.

As the second inorganic lubricant, the following commercially available products having a tap density of 0.25 g/cm$^3$ or less can be used: NX1 (boron nitride having a tap density of 0.12 g/cm$^3$, available from Momentive Performance Materials Inc.); PCTP2 (boron nitride having a tap density of 0.2 g/cm$^3$, available from Saint-Gobain K.K.); HP-P1 (boron nitride having a tap density of 0.25 g/cm$^3$, available from Mizushima Ferroalloy Co., Ltd.); and Y-3000 (mica having a tap density of 0.25 g/cm$^3$, available from YAMAGUCHI MICA CO., LTD.). Each of these compounds can be used alone or in combination with others.

The content rate of the inorganic lubricant in the image bearer protective agent is preferably from 2% to 30% by mass, more preferably from 5% to 25% by mass. When the content rate is 2% by mass or more, the film thickness of the image bearer protective agent formed on the image bearer becomes proper, thus improving charger contamination prevention performance and cleaning ability. When the content rate is 30% by mass or less, image bearer protection performance is good.

Mass Ratio of Fatty Acid Metal Salt to Inorganic Lubricant

The mass ratio of the fatty acid metal salt to the inorganic lubricant preferably ranges from 70/30 to 98/2, more preferably from 75/25 to 95/5. When the mass ratio of the fatty acid metal salt to the inorganic lubricant is 70/30 or more, the amount of the inorganic lubricant in the resulting film is increased, thus improving charger contamination prevention performance and cleaning ability. When the mass ratio of the fatty acid metal salt to the inorganic lubricant is 98/2 or less, image bearer protection performance and moldability of the image bearer protective agent are improved. When the mass ratio of the fatty acid metal salt to the inorganic lubricant is within the above-described preferable range, film formation property of the inorganic lubricant improves, thereby improving charger contamination prevention performance, cleaning ability, image bearer protection performance, and moldability of the image bearer protective agent.

Other Components

The image bearer protective agent may further include other components such as inorganic particles (e.g., silica, alumina, ceria, zirconia, clay, calcium carbonate), the surfaces of which may be hydrophobized, organic particles (e.g., polymethyl methacrylate particles, polystyrene particles, silicone resin particles, α-olefin-norbornene copolymer resin particles), and surfactants.

The image bearer protective agent may be molded into a specific shape, such as a prismatic columnar shape and a cylindrical shape, by any known solid molding method such as compression molding, melt molding, powder molding, cold isostatic pressing (CIP), and hot isostatic pressing (HIP). Among these methods, compression molding is preferable because the compression-molded product is easy to shave.

The compression molding may include the processes of: leveling a mixture of the fatty acid metal salt and the inorganic lubricant in a mold having a specific size; compression-molding the mixture in the mold with a predetermined pressure for a predetermined time; cooling the mixture; and taking the molded product out from the mold. The molded product may be further subjected to a cutting process to adjust the shape of the image bearer protective agent.

The melt molding may include the processes of: heating a mold having a specific shape to above the melting point of the image bearer protective agent; pouring a predetermined amount of a heat-melted mixture of the fatty acid metal salt and the inorganic lubricant in the heated mold; optionally maintaining the mixture at a temperature equal or higher than the melting point for a predetermined time period; cooling the mixture in the mold; and talking the molded product out from the mold. For the purpose of removing an internal strain in the molded product, the mixture may be gently reheated to above the transition temperature of the fatty acid metal salt and the inorganic lubricant during the cooling process, after they have cooled to below the transition temperature.

After being cooled to near room temperature, the molded product of the image bearer protective agent is taken out from the mold. The molded product may be further subjected to a cutting process to adjust the shape of the image bearer protective agent.

Preferably, the mold is a metallic mold made of steel, stainless steel, or aluminum, which have good thermal conductivity and dimension accuracy. Preferably, the inner wall surfaces of the mold are coated with a release agent, such as a fluororesin and a silicone resin, for improving releasability.

The resulting block of the image bearer protective agent may be attached to a substrate, such as a metal, an alloy, and a plastic material, with an adhesive.

The image bearer protective agent preferably has a density of from 1.11 to 1.27 g/cm$^3$, more preferably from 1.11 to 1.190 g/cm$^3$, and most preferably from 1.116 to 1.180 g/cm$^3$.

When the image bearer protective agent is compression-molded at a pressure of 130 kN for 10 seconds, the compression-molded image bearer protective agent preferably has a density of from 1.11 to 1.190 g/cm$^3$, more preferably from 1.116 to 1.180 g/cm$^3$. When the density is in the range of from 1.11 to 1.190 g/cm$^3$, the image bearer protective agent can be easily supplied onto an image bearer with an image bearer protective agent supply member, such as an urethane roller.

The density is calculated by dividing the mass (W) of the image bearer protective agent by the volume (V) of the image bearer protective agent. The mass (W) can be measured with an analytical balance (model: AM204-S available from Mettler-Toledo International Inc.). The volume (V) can be measured with a micrometer or a vernier caliper.

Protective Layer Forming Device

The protective layer forming device according to an embodiment of the present invention includes the above-described image bearer protective agent and an image bearer protective agent supply member. Preferably, the protective layer forming device further includes a protective layer forming member. The protective layer forming device may further include other members, such as a pressing member, if necessary.

The image bearer protective agent supply member supplies the image bearer protective agent onto a surface of an image bearer.

The protective layer forming member presses the image bearer protective agent supplied onto the surface of the image bearer against the surface, to form the image bearer protective agent into a protective layer on the surface.

The pressing member presses the image bearer protective agent against the image bearer protective agent supply member.

In a case in which the protective layer forming device includes the protective layer forming member, the protective layer forming member may have a function of a cleaner. However, for reliable formation of the protective layer, it is preferable that a cleaner is independently provided, so that residual matters (containing toner as a major component) remaining on the image bearer are previously removed by the cleaner without being mixed in the protective layer.

FIG. 1 is a schematic view of a protective layer forming device according to an embodiment of the present invention.

Referring to FIG. 1, a protective layer forming device 2 is disposed facing an image bearer 1 being a photoconductor drum. The protective layer forming device 2 includes an image bearer protective agent 21 according to an embodiment of the present invention, an image bearer protective agent supply member 22, a pressing member 23, and a protective layer forming member 24.

The image bearer protective agent 21 is brought into contact with the image bearer protective agent supply member 22, which may be a foam roller, as the pressing member 23 applies a pressing force to the image bearer protective agent 21. The image bearer protective agent supply member 22 slidably contacts the image bearer 1 while rotating at a linear speed different from that of the image bearer 1. At this time, the image bearer protective agent 21 retained on the surface of the image bearer protective agent supply member 22 is supplied onto the surface of the image bearer 1.

Depending on the material type, the image bearer protective agent 21 supplied onto the surface of the image bearer 1 is not always formed into a reliable protective layer at the time of being supplied. In this case, the protective layer forming member 24 forms the image bearer protective agent 21 supplied onto the surface of the image bearer 1 into a thin layer to form a more uniform protective layer.

After the protective layer has been formed on the image bearer 1, a charger 3 (e.g., charging roller), to which a direct-current voltage or a voltage in which a direct-current voltage is overlapped with an alternating-current voltage is applied from a high-voltage supply, is brought into contact with or close to the image bearer 1, to charge the image bearer 1 by causing electric discharge in a micro gap formed therebetween. At this time, a part of the protective layer is decomposed or oxidized by electric stress. In addition, aerial discharge products are deposited on the surface of the protective layer.

The deteriorated image bearer protective agent is removed by a cleaner along with residual matters (e.g., toner) remaining on the image bearer 1. The function of the cleaner may be provided by the protective layer forming member 24. However, it is preferable that the function of removing residual matters remaining on the image bearer 1 and the other function of forming a protective layer on the image bearer 1 are separately provided by independent members, because each function requires the member slidably contact the image bearer 1 in a different manner. Therefore, as illustrated in FIG. 1, it is preferable that a cleaner 4, including a cleaning member 41 and a cleaning member pressing mechanism 42, is provided upstream from the image bearer protective agent supply member 22.

The protective layer forming member 24 may be a rubber blade formed of urethane rubber, hydrin rubber, silicone rubber, and/or fluorine rubber. With respect to such a rubber blade, a contact point with the image bearer may be coated or impregnated with a low-friction-coefficient material. To adjust the density of the rubber blade that is an elastic body, a filler (e.g., an organic filler, an inorganic filler) may be dispersed in the rubber blade.

The blade is fixed to a blade support by means of adhesion or fusion such that a leading edge thereof is pressed against the surface of the image bearer. The thickness of the blade is determined based on the pressing force to be applied to the blade. Preferably, the thickness of the blade is in the range of from 0.5 to 5 mm, more preferably from 1 to 3 mm.

The free length of the blade, which is the length of a part of the blade protruding from the blade support to be bendable, is also determined based on the pressing force to be applied to the blade. Preferably, the free length of the blade is in the range of from 1 to 15 mm, more preferably from 2 to 10 mm.

The blade may also be an elastic metallic blade (e.g., spring plate) which may have a coating layer formed by coating or dipping, optionally using a coupling agent or a primer. Such a blade may be further subjected to thermal curing and/or surface polishing.

The coating layer includes a binder resin and a filler. The coating layer may include other components, if necessary.

Specific examples of the binder resin include, but are not limited to, fluoropolymers (e.g., PFA (perfluoroalkoxy alkane), PTFE (polytetrafluoroethylene), FEP (fluorinated ethylene-propylene), PVDF (polyvinylidene fluoride)), fluorine rubbers, and silicone elastomers (e.g., methyl phenyl silicone elastomer).

The thickness of the elastic metallic blade is in the range of from 0.05 to 3 mm, more preferably from 0.1 to 1 mm, but is not limited thereto. To suppress the elastic metallic blade from twisting, the elastic metallic blade may be subjected to a bending process, after being attached to the blade support, so as to bend in a direction substantially parallel to the support axis.

The protective layer forming member 24 is pressed against the image bearer 1 with a pressing force which makes the image bearer protective agent 21 extend to become a protective layer or film. Specifically, the pressing force has a linear pressure of from 5 to 80 gf/cm, more preferably from 10 to 60 gf/cm, but is not limited thereto.

The image bearer protective agent supply member 22 may be a brush-like member or a foam roller. Preferably, the image bearer protective agent supply member 22 is a foam roller.

Foam Roller

The foam roller includes a core material and a foam layer containing multiple cells, formed on the outer peripheral surface of the core material.

Core Material

The core material is not limited in material, shape, size, and structure.

Specific examples of the core material include, but are not limited to, resins (e.g., epoxy resin, phenol resin) and metals (e.g., iron, aluminum, stainless steel).

The shape of the core material may be columnar or cylindrical.

The core material may have an adhesive layer on the surface thereof.

Foam Layer

The foam layer is formed on the outer peripheral surface of the core material, and contains multiple cells (maybe also called as "pores" or "voids").

The shape of the foam layer may be cylindrical, but is not limited thereto.

The material of the foam layer may be a foamed polyurethane, but is not limited thereto.

A conventional brush-like member, such as that described in JP-2010-39304-A, can be used as the image bearer protective agent supply member 22. However, the foam roller is more preferable, because the foam roller can supply the image bearer protective agent onto the image bearer more uniformly, providing better image bearer protection performance.

The foam roller also solves the problem of the brush-like member that the scraped amount of the image bearer protective agent fluctuates with deterioration of the brush.

The foamed polyurethane can be produced by any known production method. The foamed polyurethane may be produced from raw materials including a polyol, a polyisocyanate, a catalyst, a foaming agent, and a foam stabilizer.

Polyol

The polyol may be a polyether polyol or a polyester polyol, but is not limited thereto. From the aspect of the ease in adjusting processability or hardness of the foam layer, a polyether polyol is preferable.

The polyether polyol may be obtained by a ring-opening addition polymerization of ethylene oxide and/or propylene oxide, using an initiator including a low-molecular polyol and/or low-molecule polyamine having 2 to 8 active hydrogen groups.

Specific examples of the polyether polyol include, but are not limited to, a polyether polyether polyol, a polyester polyether polyol, and a polymer polyether polyol, which are generally used for producing soft polyurethane foam.

From the aspect of moldability, a polyether polyether polyol including 5% by mol or more of ethylene oxide on its terminal is preferable as the polyether polyol.

The polyester polyol may be obtained by a polymerization between a dibasic acid (e.g., adipic acid, phthalic acid, isophthalic acid, terephthalic acid, maleic acid) or anhydride thereof, and a glycol or triol (e.g., ethylene glycol, diethylene glycol, triethylene glycol, propylene glycol, dipropylene glycol, 1,4-butanediol, glycerin, trimethylolpropane).

The polyester polyol may also be obtained by depolymerizing a polyethylene terephthalate waste material by glycol.

Each of these polyols can be used alone or in combination with others.

Polyisocyanate

Specific examples of the polyisocyanate include, but are not limited to, 2,4-tolylene diisocyanate (2,4-TDI), 2,6-tolylene diisocyanate (2,6-TDI), tolidine diisocyanate (TODI), naphthylene diisocyanate (NDI), xylylene diisocyanate (XDI), 4,4'-diphenylmethane diisocyanate (MDI), carbodiimide-modified MDI, polymethylene polyphenyl polyisocyanate, and polymeric polyisocyanate. Each of these compounds can be used alone or in combination with others.

The equivalent ratio (NCO/OH) of isocyanate groups (NCO) in the polyisocyanate to hydroxyl groups (OH) in the polyol preferably ranges from 1.0 to 3.0.

Catalyst

The catalyst is selected from known catalysts generally used for urethane-forming reactions, such as amine catalysts and organic metal catalysts.

Specific examples of the amine catalysts include, but are not limited to, triethylenediamine, dimethylethanol amine, and bis(dimethylamino)ethyl ether.

Specific examples of the organic metal catalysts include, but are not limited to, dioctyltin dibutyrate and distearyltin dibutyrate.

The catalyst may be a reactive catalyst, such as dimethylaminoethanol having an active hydrogen.

Each of these compounds can be used alone or in combination with others.

The content rate of the catalyst is preferably in the range of from 0.01 to 20 parts by mass based on 100 parts by mass of the polyol, but is not limited thereto.

By controlling the type and amount of the catalyst, the cell wall width, open cell diameter, hardness, and aeration quantity of the foam layer can be adjusted.

Foaming Agent

Specific examples of the foaming agent include, but are not limited to, water, chlorofluorocarbon compounds, and low-boiling-point hydrocarbon compounds. Each of these compounds can be used alone or in combination with others. Among these compounds, water is preferable from the environmental aspect.

Specific examples of the chlorofluorocarbon compounds include, but are not limited to, HCFC-141b, HFC-134a, HFC-245fa, and HFC-365mfc.

Specific examples of the low-boiling-point hydrocarbon compounds include, but are not limited to, cyclopentane, n-pentane, isopentane, and n-butane.

The content rate of the foaming agent is preferably in the range of from 5 to 50 parts by mass based on 100 parts by mass of the polyol, but is not limited thereto.

By controlling the type and amount of the foaming agent, the cell wall width, open cell diameter, hardness, and aeration quantity of the foam layer can be adjusted.

Foam Stabilizer Specific examples of the foam stabilizer include, but are not limited to, silicone-based surfactants.

Specific examples of the silicone-based surfactants include, but are not limited to, dimethylsiloxane foam stabilizers (e.g., SRX-253 available from Dow Corning Toray Co., Ltd., F-122 available from Shin-Etsu Chemical Co., Ltd.) and polyether-modified dimethylsiloxane foam stabilizers (e.g., L-5309 and SZ-1311 available from NUC Corporation). Each of these compounds can be used alone or in combination with others.

The content rate of the foam stabilizer is preferably in the range of from 0.2 to 10 parts by mass based on 100 parts by mass of the polyol, but is not limited thereto.

Other Components

The raw materials of the foamed polyurethane may further include a cross-linker, a foam breaker, a conductive agent, an antistat, a flame retardant, a viscosity reducer, a pigment, a stabilizer, a colorant, an age resistor, an ultraviolet absorber, and/or an antioxidant.

The purpose of blending the cross-linker and foam breaker is to control closed cell property and open cell property of the foam layer.

Specific examples of the cross-linker include, but are not limited to, triethanolamine and diethanolamine.

Specific examples of the foam breaker include, but are not limited to, some of the above-described foam stabilizers which have high foam breaking property.

The blending amount of the cross-linker and foam breaker is not limited to any particular value.

The raw materials other than polyisocyanate are previously mixed. The polyisocyanate is mixed therein immediately before molding.

As the foamed polyurethane, commercially-available products, such as HR20, HR30, QM60, QZK50, and QZK70 (available from Bridgestone Diversified Chemical Products Co., Ltd.), can be used.

The foam layer may have either a closed-cell structure, an open-cell structure, or a mixed structure thereof.

Figure 2A:
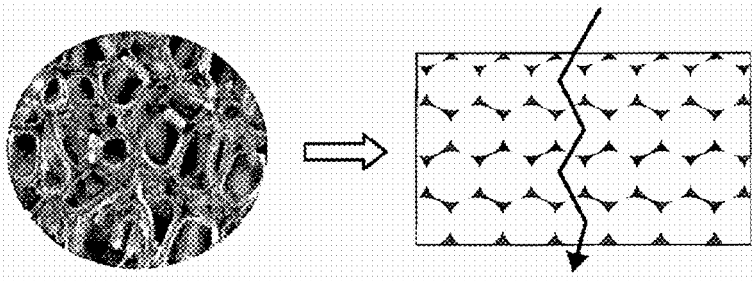
FIG. 2A is a schematic cross-sectional view of an open-cell foam layer.
Figure 2B:
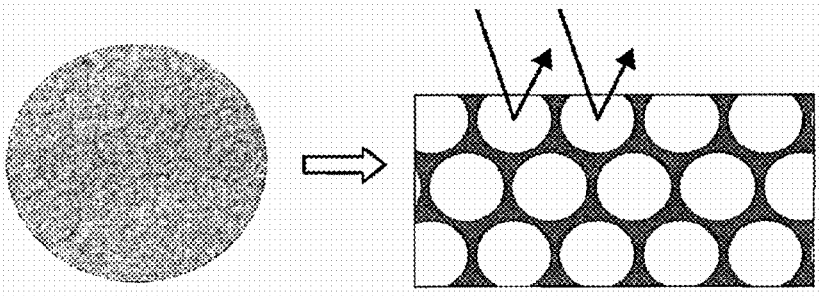
FIG. 2B is a schematic cross-sectional view of a closed-cell foam layer.

FIG. 2A is a schematic cross-sectional view of an open-cell foam layer. In the open-cell foam layer, adjacent cells are connected to each other. Therefore, the open-cell foam layer allows air and water to pass through. FIG. 2B is a schematic cross-sectional view of a closed-cell foam layer. In the closed-cell foam layer, cells are independent from each other. Therefore, the closed-cell foam layer cannot allow air and water to pass through.

The open-cell foam layer easily returns to the original shape when compressed, because a residual compression strain is small. Therefore, the open-cell foam layer is not almost deformed even after a long-term use, which is preferable. In addition, compared to the closed-cell foam layer, the open-cell foam layer is less likely to cause scattering of the protective agent when slidably abrading the protective agent, which is advantageous in terms of cost. Moreover, the open-cell foam layer is capable of forming a uniform protective layer on the image bearer with a small supply of a protective agent, which prevents the occurrence of filming on the image bearer. Thus, the protective agent can be formed into a small block and therefore the apparatus as a whole can be made compact.

The average cell diameter of the foam roller is equal to or less than the number-based median diameter ($D_{50}$) of the image bearer protective agent. Preferably, the average cell diameter is in the range of from 400 to 850 μm, more preferably from 500 to 700 μm, for well grinding the image bearer protective agent and uniformly supplying the image bearer protective agent onto the surface of the image bearer. When the average cell diameter is 400 μm or more, it becomes much easier to grind the image bearer protective agent, making supply of the image bearer protective agent stable, in a case in which the image bearer protective agent is in the form of a molded block. When the average cell diameter is 850 m or less, the contact area between the image bearer protective agent and the image bearer is partially increased, making it much easier to uniformly supply the image bearer protective agent onto the image bearer.

The average cell diameter of the foam roller can be determined by, for example, dividing a length of 1 inch (=25.4 mm) by the number of cells measured in the following manner.

Figure 3A:
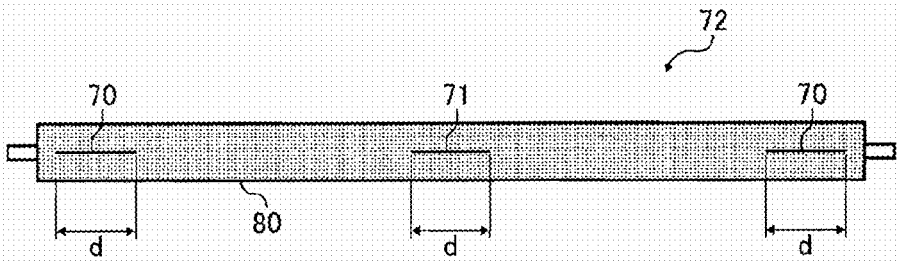
FIG. 3A is a side view of an image bearer protective agent supply member according to an embodiment of the present invention.
Figure 3B:
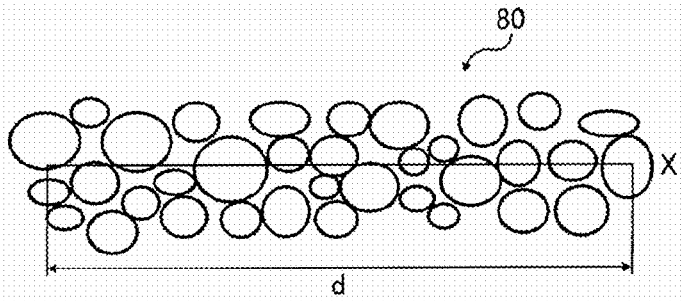
FIG. 3B is a magnified schematic view of an exposed surface of an open-cell foam layer of the image bearer protective agent supply member illustrated in FIG. 3A.

First, as illustrated in FIG. 3A, select three arbitrary portions (including end portions 70 and a center portion 71) on the surface of a foam layer 80 of a foam roller 72 as measuring portions. Additionally, select two portions on the surface of the foam layer 80 in the peripheral direction of each of the above-selected measuring portions. Thus, in total, 9 measuring portions are selected. Next, observe each measuring portion with a microscope and photograph the measuring portion. In each photograph, as illustrated in FIG. 3B, draw a line X having a length of d (corresponding to an actual length of 1 inch) at the center part of each photograph, and count the number of cells on or contacting the line X. Average the numbers of cells counted at 9 measuring portions. A cell in contact with the line X, even only slightly, is counted. In the example illustrated in FIG. 3B, the number of cells on or contacting the line X is 12. The average cell diameter is determined by the following formula: 25.4 (mm)/12=2.117 (mm)=2,177 (μm).

The foam layer preferably has an average thickness of from 1 to 4 mm. When the average thickness is 1 mm or more, the foam layer is less affected by the core material (shaft). When the average thickness is 4 mm or less, the scraped amount of the image bearer protective agent is prevented from decreasing.

In a case in which the foam layer is in the form of a cylinder, the distance between the inner and outer peripheral surfaces of the cylinder corresponds to the thickness of the foam layer. The average thickness here refers to the average of thickness values measured at three arbitrary points on the foam layer.

The foam layer preferably has a hardness of from 40 to 430 N, more preferably from 40 to 300 N. When the hardness is 40 N or more, the image bearer is prevented from contamination. When the hardness is 430 N or less, the image bearer is suppressed from contamination. When the hardness is 300 N or less, the image bearer is more suppressed from contamination.

The hardness here refers to the average of hardness values measured at three arbitrary points on the surface of the foam layer, measured according to JIS K6400.

The type of cells (open-cell or closed-cell), the number of cells, and the hardness of the foam layer can be controlled by adjusting the type of raw materials of foamed polyurethane, the use amount of foaming agent, and reaction conditions in the process of producing the foam layer.

Production Method of Image Bearer Protective Agent Supply Member

The image bearer protective agent supply member can be produced by any known production method.

One example of the production method of the image bearer protective agent supply member is described below, in which the foamed polyurethane is included in the foam layer.

First, raw materials of the foamed polyurethane are subjected to foaming and curing, thus forming a foamed polyurethane block. The foamed polyurethane block is cut into a desired shape and the surface thereof is polished. Thereafter, the foamed polyurethane block is processed into a cylinder including cells which are opened at the surface. The core material is inserted into the cylinder. The foamed polyurethane cylinder is then subjected to a cutting process (traverse grinding) in which a grinding blade is brought into contact with the foamed polyurethane which is rotating, while moving in the axial direction of the image bearer protective agent supply member, using a grinder or cutter, to have a desired thickness. Thus, a cylindrical image bearer protective agent supply member including cells which are opened at the surface is provided. It is possible to give irregular concavities/convexities on the surface of the foam layer by varying the rotation speed or movement speed of the image bearer protective agent supply member.

To improve adhesion property between the foam layer and the core material, an adhesive material may be applied to the core material.

Another example of the production method of the image bearer protective agent supply member is described below.

First, the core material is stored in a mold for molding the image bearer protective agent supply member, and raw material of the formed polyurethane are poured therein and subjected to foaming and curing. Thus, the image bearer protective agent supply member is provided.

Among these production methods, the method using a mold is preferable because the method is capable of forming the foam layer and the cells opened at the surface at the same time and has a high processing accuracy.

The method using a mold is capable of forming a foam layer having good cell-opening property without a complicated process. It is preferable that a release layer formed of a fluororesin coating agent or a release agent is formed on the inner surface of the mold.

Image Forming Apparatus and Image Forming Method

The image forming method according to an embodiment of the present invention includes at least an electrostatic latent image forming process, a developing process, a transfer process, and a protective layer forming process. The image forming method may optionally include other processes, such as a fixing process, a cleaning process, a neutralization process, a recycle process, and a control process, if necessary.

The image forming apparatus according to an embodiment of the present invention includes at least an image bearer, an electrostatic latent image forming device, a developing device, a transfer device, and a protective layer forming device. The image forming apparatus may optionally include other devices, such as a cleaner, a fixing device, a neutralizer, a recycler, and a controller, if necessary.

The image forming method according to an embodiment of the present invention is preferably performed by the image forming apparatus according to an embodiment of the present invention. The electrostatic latent image forming process may be performed by the electrostatic latent image forming device. The developing process may be performed by the developing device. The transfer process may be performed by the transfer device. The protective layer forming process may be performed by the protective layer forming device. The other processes may be performed by the respective other devices.

Image Bearer

As the image bearer, an image bearer described at paragraphs [0049] to [0084] of JP-2014-142538-A can be used, but the image bearer is not limited thereto.

Electrostatic Latent Image Forming Process and Electrostatic Latent Image Forming Device The electrostatic latent image forming process is a process in which an electrostatic latent image is formed on the image bearer, which can be performed by the electrostatic latent image forming device.

The electrostatic latent image may be formed as the electrostatic latent image forming device uniformly charges a surface of the image bearer and irradiates the charged surface with light containing image information. The electrostatic latent image forming device may include at least a charger to charge a surface of the image bearer and an irradiator to irradiate the charged surface of the image bearer with light containing image information.

In the charging process, the charger charges a surface of the image bearer by applying a voltage thereto.

Specific examples of the charger include, but are not limited to, a contact charger equipped with a conductive or semiconductive roller, brush, film, or rubber blade, and a non-contact charger employing corona discharge, such as corotron and scorotron.

Preferably, the charger includes a voltage applier to apply a voltage having an alternating current component.

In the irradiation process, the irradiator irradiates the surface of the electrostatic latent image bearer with light containing image information.

Specific examples of the irradiator include, but are not limited to, various irradiators of radiation optical system type, rod lens array type, laser optical type, and liquid crystal shutter optical type.

Developing Process and Developing Device

The developing process is a process in which the electrostatic latent image is developed into a visible image with toner or developer.

The visible image may be formed as the developing device develops the electrostatic latent image with toner or developer.

The developing device may be configured to contain toner or developer and supply the toner or developer to the electrostatic latent image in either a contact or non-contact manner.

As the toner, a toner described at paragraphs [0089] to [0179] of JP-2014-142538-A can be used, but the toner is not limited thereto.

The developing device may be of either a dry developing type or a wet developing type. In addition, the developing device may be of either a monochrome developing type or a multicolor developing type. Preferably, the developing device includes a stirrer to frictionally stir the toner or developer to charge it, and a rotatable magnet roller.

In the developing device, the toner and carrier particles are mixed and stirred, and the toner particles are charged by friction. The charged toner particles are retained on the surface of a rotating magnet roller in the form of ears, forming magnetic brush. The magnet roller is disposed adjacent to the image bearer. Therefore, part of the toner particles composing the magnetic brush formed on the surface of the magnet roller are moved to the surface of the image bearer by an electric attractive force. As a result, the electrostatic latent image is developed with the toner particles to form a visible image on the surface of the image bearer.

The developer may be either a one-component developer including the toner or a two-component developer including the toner and a carrier.

Transfer Process and Transfer Device

The transfer process is a process in which the visible image is transferred onto a recording medium. It is preferable that the visible image is primarily transferred onto an intermediate transfer medium and then secondarily transferred onto the recording medium. It is preferable that at least two toners, preferably multiple toners for forming full-color images, are used. The transfer process preferably includes a primary transfer process in which the visible image is transferred onto an intermediate transfer medium to form a composite image, and a secondary transfer process in which the composite image is transferred onto a recording medium.

The visible image may be transferred as the transfer device charges the image bearer by a transfer charger. The transfer device preferably includes a primary transfer device to transfer the visible image onto an intermediate transfer medium to form a composite image and a secondary transfer device to transfer the composite image onto a recording medium.

Specific examples of the intermediate transfer medium include, but are not limited to, a transfer belt.

The image bearer may combine a function of an intermediate transfer medium on which a toner image is to be primarily transferred from the image bearer before being transferred onto a recording medium.

Intermediate Transfer Medium

As the intermediate transfer medium, an intermediate transfer member described at paragraphs [0184] to [0185] of JP-2014-142538-A can be used, but the intermediate transfer medium is not limited thereto.

The transfer device (the primary transfer device, the secondary transfer device) preferably includes a transferrer to separate the visible image formed on the image bearer to the recording medium side by charging. The transfer device may include multiple transfer devices. Specific examples of the transferrer include, but are not limited to, corona transferrer, transfer belt, transfer roller, pressure transfer roller, and adhesive transferrer.

As the recording medium, any known recording medium (e.g., recording paper) can be used.

Protective Layer Forming Process and Protective Layer Forming Device

The protective layer forming process is a process in which the image bearer protective agent according to an embodiment of the present invention is supplied onto the surface of the image bearer after the visible image has been transferred therefrom, and formed into a protective layer.

The protective layer forming device supplies the image bearer protective agent according to an embodiment of the present invention onto the surface of the image bearer after the visible image has been transferred therefrom, and forms the image bearer protective agent into a protective layer.

Other Processes and Other Devices

The other processes may include, for example, a fixing process, a cleaning process, a neutralization process, a recycle process, and a control process.

The other devices may include, for example, a fixing device, a cleaner, a neutralizer, a recycler, and a controller.

Fixing Process and Fixing Device

The fixing process is a process in which the visible image transferred onto the recording medium is fixed thereon by the fixing device. The fixing process may be performed either every time each color toner is transferred onto the recording medium or at once after all color toners are superimposed on one another.

The fixing device preferably includes a heat-pressure member. Specific examples of the heat-pressure member include, but are not limited to, a combination of a heat roller and a pressure roller; and a combination of a heat roller, a pressure roller, and an endless belt.

The heat-pressure member may be heated to 80° C. to 200° C.

The fixing device may be used together with or replaced with an optical fixer.

Cleaning Process and Cleaner

The cleaning process is a process in which residual toner particles remaining on the image bearer are removed, which is preferably performed by the cleaner.

The cleaner is preferably provided downstream from the transfer device and upstream from the protective layer forming device.

The cleaner is not limited in configuration so long as residual toner particles remaining on the image bearer can be removed. Specific examples of the cleaner include, but are not limited to, a magnetic brush cleaner, an electrostatic brush cleaner, a magnetic roller cleaner, a blade cleaner, a brush cleaner, and a web cleaner.

Neutralization Process and Neutralizer

The neutralization process is a process in which the image bearer is neutralized by being applied with a neutralization bias, which is preferably performed by the neutralizer.

The neutralizer is not limited in configuration so long as a neutralization bias can be applied to the image bearer. Specific examples of the neutralizer include, but are not limited to, a neutralization lamp.

Recycle Process and Recycler

The recycle process is a process in which the toner particles removed in the cleaning process are recycled by the developing device, which is preferably performed by the recycler. Specific examples of the recycler include, but are not limited to, a conveyer.

Control Process and Controller

The control process is a process in which the above-described processes are controlled, which is preferably performed by the controller.

The controller is not limited in configuration so long as the above-described processes can be controlled. Specific examples of the controller include, but are not limited to, a sequencer and a computer.

Figure 4:
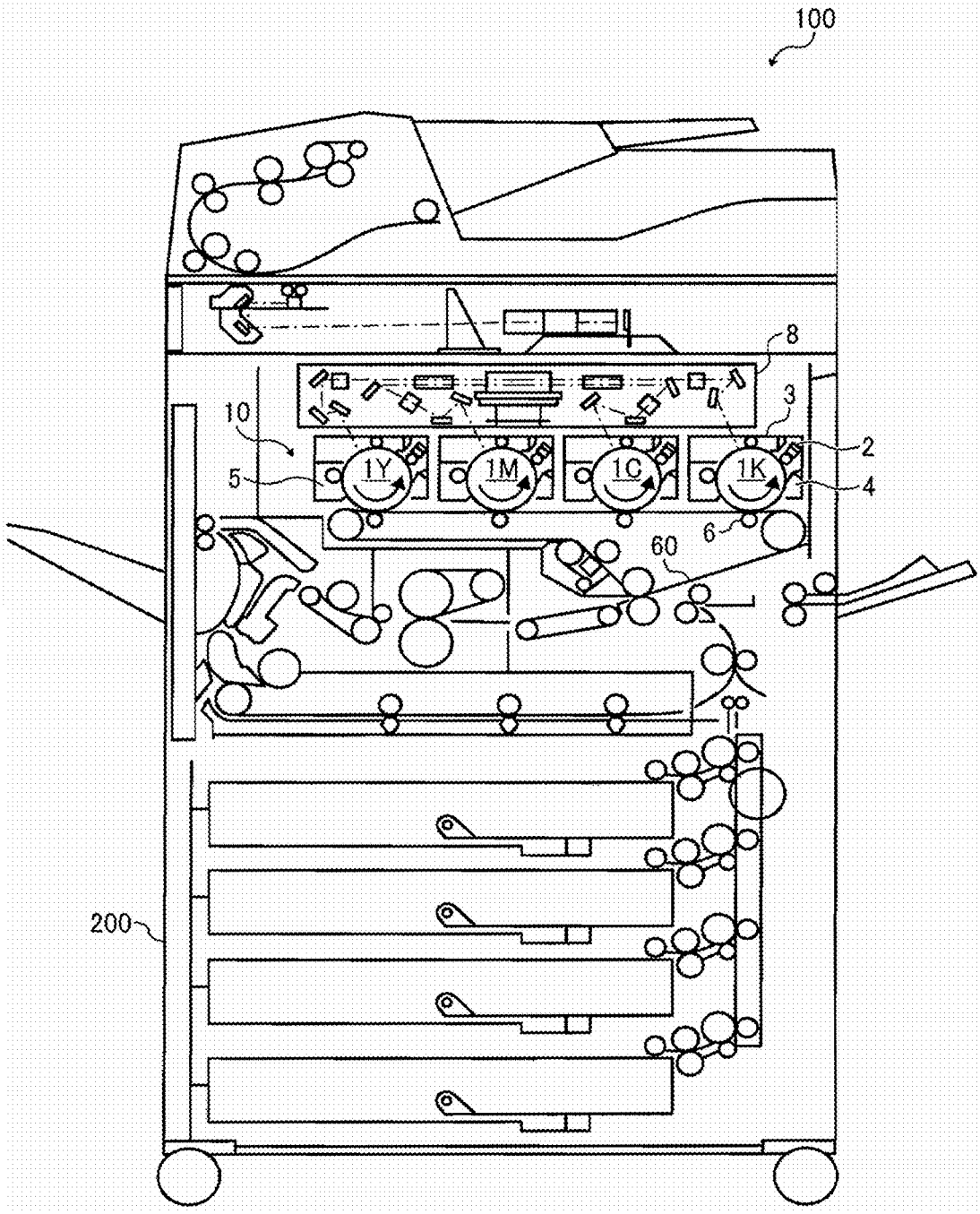
FIG. 4 is a schematic view of an image forming apparatus according to an embodiment of the present invention.

FIG. 4 is a cross-sectional view of an image forming apparatus including the protective layer forming device according to an embodiment of the present invention.

Referring to FIG. 4, an image forming apparatus 100 includes drum-like image bearers 1Y, 1M, 1C, and 1K (hereinafter each one of them may be referred to as "image bearer 1"). Around each image bearer 1, the protective layer forming device 2, a charger 3, an irradiator 8, a developing device 5, a transfer device 6, and the cleaner 4 are provided. The additional characters Y, M, C, and K represent yellow, magenta, cyan, and black, respectively.

An image forming process performed by the image forming apparatus 100, in particular a negative-positive process, is described below.

The image bearer 1 may be an organic photoconductor (OPC) having an organic photoconductive layer. The image bearer 1 is neutralized by a neutralization lamp and uniformly charged to a negative potential by the charger 3.

At the time when each charger 3 charges each image bearer 1, a voltage application mechanism applies an appropriate voltage, or a charging voltage in which an alternating current voltage is superimposed on that appropriate voltage, to the charger 3, so that the image bearers 1Y, 1M, 1C, and 1K are charged to a desired potential.

Each image bearer 1 thus charged is then irradiated with laser light emitted from each irradiator 8 (e.g., laser optical irradiator), to form a latent image thereon. On the image bearer 1, the irradiated portion has a lower potential in absolute value than the non-irradiated portion.

The laser light is emitted from a semiconductor laser. The laser light scans the surfaces of the image bearers 1Y, 1M, 1C, and 1K in the rotational axis direction of the image bearers 1Y, 1M, 1C, and 1K by the action of a polygon mirror which is rotating at a high speed.

The latent image thus formed is developed with a toner or a developer including a toner and a carrier, having been supplied onto a developing sleeve (serving as a developer bearer) of the developing device 5, to be formed into a toner image.

At the time when the electrostatic latent image is developed into a toner image, a voltage application mechanism applies an appropriate voltage, or a developing bias in which an alternating current voltage is superimposed on that appropriate voltage, to the developing sleeve. The potential of the appropriate voltage is in between the potentials of the irradiated and non-irradiated portions on the image bearer 1.

The toner images formed on the image bearers 1Y, 1M, 1C, and 1K are transferred onto an intermediate transfer medium 60 by the transfer device 6, and further transferred onto a recording medium (e.g., paper sheet) fed from a sheet feeder 200.

At the time when the toner images are transferred, a transfer bias that is a potential having an opposite polarity to the toner charge is applied to the transfer device 6. The intermediate transfer medium 60 is then separated from the image bearers 1Y, 1M, 1C, and 1K, thus obtaining a transferred image.

Residual toner particles remaining on each image bearer 1 are collected by each cleaner 4 in a toner collection chamber provided in each cleaner 4.

The image forming apparatus 100 may include a fixing device which fixes a composite toner image on a recording medium by heat. The composite toner image may be directly formed on the recording medium by sequentially transferring multiple toner images having different colors, formed by multiple developing devices, onto the recording medium. Alternatively, the composite toner image may be first formed on an intermediate transfer medium by sequentially transferring the multiple toner images having different colors on the intermediate transfer medium and then transferred onto the recording medium.

Preferably, the charger 3 is a charger including a discharge wire disposed in contact with or proximity to the surface of the image bearer 1. Such a charger is capable of drastically suppressing the amount of ozone generated at the time of charging the image bearer, compared to a corona discharger such as corotron and scorotron.

Such a charger which charges the surface of the image bearer while being in contact with or proximity to the surface of the image bearer is likely to give large electric stress to the image bearer, since electric discharge is caused near the surface of the image bearer. The image forming apparatus according to an embodiment of the present invention includes the protective layer forming device using the image bearer protective agent, as described above. Thus, the quality of the image bearer is maintained without being degraded, providing reliable image quality.

Process Cartridge

The process cartridge according to an embodiment of the present invention includes an image bearer and the protective layer forming device. The process cartridge may optionally include other devices, such as a charger, an irradiator, a developing device, a transfer device, a cleaner, and a neutralizer, if necessary.

The process cartridge is detachably mountable on various electrophotographic image forming apparatuses. Preferably, the process cartridge is detachably mounted on the image forming apparatus according to an embodiment of the present invention.

Figure 5:
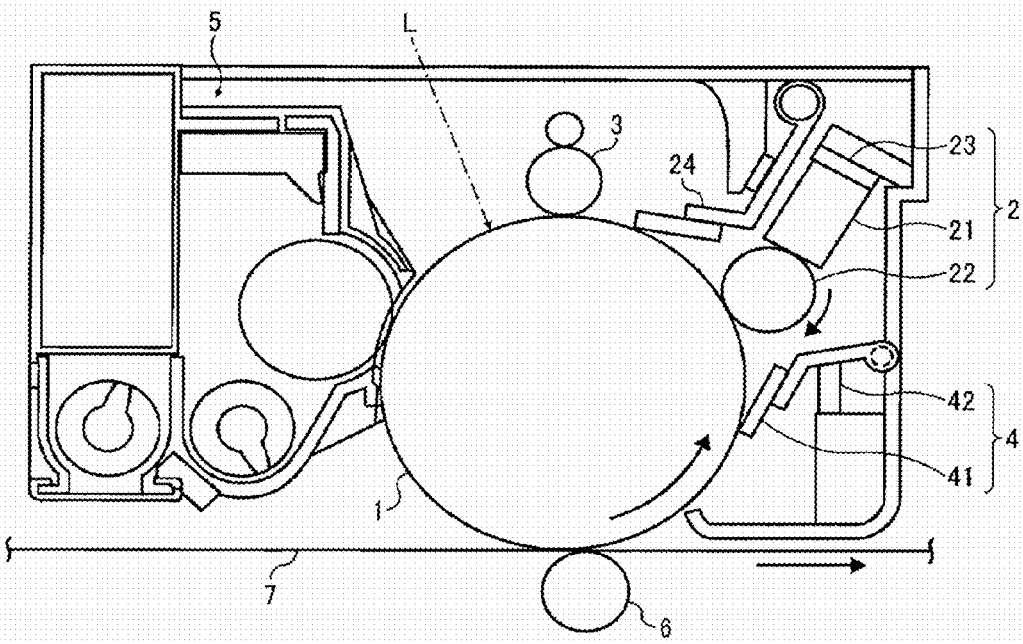
FIG. 5 is a schematic view of a process cartridge according to an embodiment of the present invention.

FIG. 5 is a schematic view of a process cartridge according to an embodiment of the present invention.

Referring to FIG. 5, the process cartridge includes the image bearer 1 being a photoconductor drum, and the protective layer forming device 2 disposed facing the image bearer 1. The protective layer forming device 2 includes the image bearer protective agent 21, the image bearer protective agent supply member 22, the pressing member 23, and the protective layer forming member 24.

On the surface of the image bearer 1, partially deteriorated image bearer protective agent and/or residual toner particles may remain after the transfer process. Such surface residues are removed by the cleaner 4.

In FIG. 5, the cleaner 4 is disposed upstream from the image bearer protective agent supply member 22. The cleaner 4 includes the cleaning member 41 and the cleaning member pressing mechanism 42. One end of cleaning member 41 is in contact with the image bearer 1 forming a certain angle so as to face in the direction of rotation of the image bearer 1.

After the cleaner 4 removes deteriorated image bearer protective agent and/or residual toner particles remaining on the surface of the image bearer 1, the image bearer protective agent supply member 22 supplies the image bearer protective agent 21 onto the surface and the protective layer forming member 24 and forms it into a film-like protective layer. Some portions on the surface of the image bearer 1 are given high hydrophilicity due to application of electric stress. The image bearer protective agent 21 exhibits high adsorptivity to such highly hydrophilic portions. Therefore, even when the surface of the image bearer is temporarily subject to a large electric stress and start deteriorating in part, the image bearer 1 protective agent 21 adsorbs to the deteriorating part to prevent deterioration progress of the image bearer 1.

After the protective layer has been formed on the image bearer 1, the image bearer 1 is charged by the charger 3 and irradiated with light L (e.g., laser light) to form an electrostatic latent image thereon. The electrostatic latent image is developed into a visible image by the developing device 5. The visible image is transferred onto a recording medium 7 by the transfer device 6 disposed outside the process cartridge.

The image forming apparatus and process cartridge according to some embodiments of the present invention prevent the image bearer from wearing, and prevent the toner from filming on the image bearer, contaminating the charger, and passing through the cleaner in the cleaning process, thereby reliably providing high quality images for an extended period of time.

EXAMPLES

Having generally described this invention, further understanding can be obtained by reference to certain specific examples which are provided herein for the purpose of illustration only and are not intended to be limiting.

In the following Examples and Comparative Examples, tap densities of inorganic lubricants were measured in the following manner.

Measurement of Tap Density

Tap density of an inorganic lubricant was measured with a powder characteristics tester (POWDER TESTER PT-X, product of Hosokawa Micron Corporation) in accordance with Japanese Pharmacopoeia.

Example 1

Preparation of Image Bearer Protective Agent

A mixture of 80 parts by mass of zinc stearate (available from Wako Pure Chemical Industries, Ltd.), serving as a fatty acid metal salt, and 20 parts by mass of a boron nitride B (HP-2W available from Mizushima Ferroalloy Co., Ltd., having a tap density of 0.3 g/cm$^3$), serving as an inorganic lubricant, was put in a mold and evened out. The mixture in the mold was compressed with a pressure of 130 kN for a compression time of 10 seconds, and then cooled. The resulting solid was taken out of the mold and cut into a block with sides having a length of 10 mm, 21 mm, and 300 mm. The block was attached to a metallic support with a double-sided adhesive tape. Thus, an image bearer protective agent was prepared. The density of the image bearer protective agent was calculated by dividing the mass (W) of the image bearer protective agent by the volume (V) of the image bearer protective agent. The mass (W) was measured with an analytical balance (model: AM204-S available from Mettler-Toledo International Inc.). The volume (V) was measured with a micrometer. As a result, the density was 1.18 g/cm$^3$.

The image forming apparatus illustrated in FIG. 4, i.e., IMAGIO MP C4500 available from Ricoh Co., Ltd., was modified such that the mounted image bearer protective agent was replaced with the above-prepared image bearer protective agent in Example 1. The image bearer protective agent of Example 1 was applied to the image bearer mounted on the image forming apparatus (IMAGIO MP C4500). The image bearer protective agent supply member mounted on the image forming apparatus (IMAGIO MP C4500) was a urethane roller. The urethane roller (product of Bridgestone Corporation) was formed of a metallic cored bar having an outer diameter of 6 mm and a length of 365 mm, and an open-cell polyurethane foam layer formed on the outer peripheral surface of the cored bar. The urethane roller had an outer diameter of 12 mm. The number of cells was 60, and the cell diameter of opened cells was 420 am. The toner mounted on the image forming apparatus (IMAGIO MP C4500) was used as it was.

Examples 2-13 and Comparative Examples 1-4

Image bearer protective agents of Examples 2-13 and Comparative Examples 1-4 were each prepared in the same manner as Example 1 except for changing the types and contents of the fatty acid metal salt and inorganic lubricant and the molding method of protective agent according to the descriptions in Tables 1-4.

In addition, in Example 13, the urethane roller mounted on the image forming apparatus used in Example 1 was replaced with a brush roller (product name: SA-7 (acrylic), available from Toray Industries, Inc.). Tap density of each image bearer protective agent was measured in the same manner as Example 1. The measurement results are listed in Tables 1-4.

Examples 14-15

Preparation of Image Bearer Protective Agent

A mixture of 80 parts by mass of zinc stearate (available from Wako Pure Chemical Industries, Ltd.), serving as a fatty acid metal salt, and 20 parts by mass of a boron nitride B (HP-2W available from Mizushima Ferroalloy Co., Ltd., having a tap density of 0.3 g/cm$^3$), serving as an inorganic lubricant, was melted by heat and injected into a metallic mold. The mixture in the mold was cooled and solidified. The resulting solid was taken out of the mold and cut into a block with sides having a length of 10 mm, 21 mm, and 300 mm. The block was attached to a metallic support with a double-sided adhesive tape. Thus, an image bearer protective agent was prepared.

In Example 14, this image bearer protective agent was mounted on the image forming apparatus used in Example 1 in the same manner as Example 1.

In Example 15, the urethane roller mounted on the image forming apparatus used in Example 14 was replaced with a brush roller (product name: SA-7 (acrylic), available from Toray Industries, Inc.).

Tap density of the image bearer protective agent used in Examples 14-15 was measured in the same manner as Example 1. The measurement results are listed in Table 3.

Charger contamination prevention performance, image bearer protection performance, cleaning ability, and moldability of each image bearer protective agent were evaluated using the above image forming apparatus in the following manner. The evaluation results are listed in Tables 1-4.

Charger Contamination Prevention Performance

An A4-size test chart having an image area ratio of 5% was printed on 100,000 sheets in a normal temperature environment (23° C., 50% RH) or a low temperature environment (10° C., 15% RH). After the printing, the charger (charging roller) was visually observed to evaluate charger contamination prevention performance based on the following criteria.

Evaluation Criteria

A: The charger was almost not contaminated.

B: The charger was slightly contaminated, but the image output in the normal temperature environment (23° C., 50% RH) was not adversely affected.

C: The charger was contaminated. An abnormal image with black streaks appeared in the low temperature environment (10° C., 15% RH).

D: The charger was significantly contaminated. An abnormal image with black streaks appeared in the low temperature environment (10° C., 15% RH) from the initial stage (about 5,000th sheet) of the printing.

Image Bearer Protection Performance

An A4-size test chart having an image area ratio of 5% was printed on 100,000 sheets in a normal temperature environment (23° C., 50% RH). After the printing, the image bearer was visually observed to evaluate image bearer protection performance based on the following criteria.

Evaluation Criteria

A: The image bearer was almost not worn. Almost no filming was observed on the image bearer.

B: Filming was slightly observed on the image bearer, but it was an acceptable level.

C: Filming was observed on the image bearer. An abnormal image with white streaks appeared with time (about 20,000th sheet).

D: Filming was observed on the image bearer. An abnormal image with white streaks appeared from the initial stage (about 5,000th sheet) of the printing.

Cleaning Ability

A first running test in which an image was continuously printed on 500 sheets of paper was conducted. After the running test, the image bearer was replaced with a new one, and a passed-through toner catcher (formed of a piece of felt with sides having lengths of 8 mm and 310 mm, having an average thickness of 1 mm, available from Tsuchiya Co., Ltd.) was attached to an upper end of the opening of the developing device disposed downstream from the cleaning blade with a piece of strip-like sponge tape having an average thickness of 2 mm (SCOTCH TAPE 4016 available from 3M Japan Limited). A second running test in which a chart having an image area ratio of 5% was continuously printed on 100 sheets of paper was conducted, and a third running test in which the same chart having an image area ratio of 5% was continuously printed on 20 sheets of paper was conducted thereafter. Toner particles passed through the cleaning blade downstream after the end of the second running test and before the end of the third running test were caught by the passed-through toner catcher. An image of the caught toner particles were converted into a digital data with an image scanner. Black streaks on the image were visually observed to determine whether toner particles had passed through the cleaning blade or not. Cleaning ability was evaluated based on the following criteria.

Evaluation Criteria

A: Very few toner particles had passed through the cleaning blade.

B: Some toner particles had passed through the cleaning blade, but an abnormal image with black streaks did not appear.

C: Some toner particles had passed through the cleaning blade, and an abnormal image with black streaks appeared.

D: A large number of toner particles had passed through the cleaning blade, and an abnormal image with black streaks frequently appeared.

Moldability

Each image bearer protective agent was formed into 100 blocks. Each block was visually observed to determine whether a crack had been caused or not, and the incidence rate of crack was determined. Moldability of each image bearer protective agent was evaluated based on the following criteria.

Here, the crack is defined as a partial split generated in the longitudinal direction of the side surface of the molded image bearer protective agent.

Evaluation Criteria

A: Very few cracks were caused in the image bearer protective agent. (The incidence rate of crack is less than 5% by number.)

B: Cracks were slightly caused in the image bearer protective agent, but it was an acceptable level. (The incidence rate of crack was 5% or more and less than 10% by number.)

C: Cracks were easily caused in the image bearer protective agent. The yield was low. (The incidence rate of crack was 10% or more and less than 20% by number.)

D: Cracks were frequently caused in the image bearer protective agent. Difficult to mold the image bearer protective agent. (The incidence rate of crack was 20% by mass or more.)

TABLE 1

| | | Examples | | | | | |
|---|---|---|---|---|---|---|---|
| | | 1 | 2 | 3 | 4 | 5 | 6 |
| Molding Method of Image Bearer Protective Agent | | Compression Molding | Compression Molding | Compression Molding | Compression Molding | Compression Molding | Compression Molding |
| Image Bearer Protective Agent Supply Member | | Urethane Roller | Urethane Roller | Urethane Roller | Urethane Roller | Urethane Roller | Urethane Roller |
| Fatty Acid | Zinc Stearate | 80 | 80 | 80 | 80 | — | — |
| Metal Salts | Calcium Stearate | — | — | — | — | 80 | — |
| | Zinc Laurate | — | — | — | — | — | 80 |
| Inorganic | Boron Nitride A (Tap Density: 0.2 g/cm$^3$) | — | — | — | — | — | — |
| Lubricants | Boron Nitride B (Tap Density: 0.3 g/cm$^3$) | 20 | — | — | — | 20 | 20 |
| | Boron Nitride C (Tap Density: 0.5 g/cm$^3$) | — | 20 | — | — | — | — |
| | Boron Nitride D (Tap Density: 0.6 g/cm$^3$) | — | — | 20 | — | — | — |
| | Boron Nitride E (Tap Density: 0.8 g/cm$^3$) | — | — | — | 20 | — | — |
| | Boron Nitride F (Tap Density: 0.9 g/cm$^3$) | — | — | — | — | — | — |
| Mass Ratio (Fatty Acid Metal Salt/Inorganic Lubricant) | | 80/20 | 80/20 | 80/20 | 80/20 | 80/20 | 80/20 |
| Density of Image Bearer Protective Agent (g/cm$^3$) | | 1.180 | 1.154 | 1.142 | 1.116 | 1.180 | 1.180 |
| Evaluation | Charger Contamination Prevention Performance | A | A | A | A | B | B |
| Results | Image Bearer Protection Performance | A | A | A | A | B | B |
| | Cleaning Ability | A | A | A | A | A | A |
| | Moldability | A | A | A | A | B | B |

TABLE 2

| | | Examples | | | | | |
|---|---|---|---|---|---|---|---|
| | | 7 | 8 | 9 | 10 | 11 | 12 |
| Molding Method of Image Bearer Protective Agent | | Compression Molding | Compression Molding | Compression Molding | Compression Molding | Compression Molding | Compression Molding |
| Image Bearer Protective Agent Supply Member | | Urethane Roller | Urethane Roller | Urethane Roller | Urethane Roller | Urethane Roller | Urethane Roller |
| Fatty Acid | Zinc Stearate | 99 | 98 | 95 | 85 | 70 | 69 |
| Metal Salts | Calcium Stearate | — | — | — | — | — | — |
| | Zinc Laurate | — | — | — | — | — | — |
| Inorganic | Boron Nitride A (Tap Density: 0.2 g/cm$^3$) | — | — | — | — | — | — |
| Lubricants | Boron Nitride B (Tap Density: 0.3 g/cm$^3$) | 1 | 2 | 5 | 15 | 30 | 31 |
| | Boron Nitride C (Tap Density: 0.5 g/cm$^3$) | — | — | — | — | — | — |
| | Boron Nitride D (Tap Density: 0.6 g/cm$^3$) | — | — | — | — | — | — |
| | Boron Nitride E (Tap Density: 0.8 g/cm$^3$) | — | — | — | — | — | — |
| | Boron Nitride F (Tap Density: 0.9 g/cm$^3$) | — | — | — | — | — | — |
| Mass Ratio (Fatty Acid Metal Salt/Inorganic Lubricant) | | 99/1 | 98/2 | 95/5 | 85/15 | 70/30 | 69/31 |
| Density of Image Bearer Protective Agent (g/cm$^3$) | | 1.162 | 1.163 | 1.167 | 1.176 | 1.189 | 1.190 |
| Evaluation | Charger Contamination Prevention Performance | B | B | B | A | A | A |
| Results | Image Bearer Protection Performance | A | A | A | B | B | B |
| | Cleaning Ability | B | B | B | A | A | A |
| | Moldability | B | A | A | A | B | B |

TABLE 3

| | | Examples | | |
|---|---|---|---|---|
| | | 13 | 14 | 15 |
| Molding Method of Image Bearer Protective Agent | | Compression Molding | Melt Molding | Melt Molding |
| Image Bearer Protective Agent Supply Member | | Brush Roller | Urethane Roller | Brush Roller |
| Fatty Acid Metal Salts | Zinc Stearate | 80 | 80 | 80 |
| | Calcium Stearate | — | — | — |
| | Zinc Laurate | — | — | — |
| Inorganic Lubricants | Boron Nitride A (Tap Density: 0.2 g/cm$^3$) | — | — | — |
| | Boron Nitride B (Tap Density: 0.3 g/cm$^3$) | 20 | 20 | 20 |
| | Boron Nitride C (Tap Density: 0.5 g/cm$^3$) | — | — | — |
| | Boron Nitride D (Tap Density: 0.6 g/cm$^3$) | — | — | — |
| | Boron Nitride E (Tap Density: 0.8 g/cm$^3$) | — | — | — |
| | Boron Nitride F (Tap Density: 0.9 g/cm$^3$) | — | — | — |
| Mass Ratio (Fatty Acid Metal Salt/Inorganic Lubricant) | | 80/20 | 80/20 | 80/20 |
| Density of Image Bearer Protective Agent (g/cm$^3$) | | 1.180 | 1.270 | 1.270 |
| Evaluation Results | Charger Contamination Prevention Performance | A | A | B |
| | Image Bearer Protection Performance | B | A | B |
| | Cleaning Ability | B | B | B |
| | Moldability | A | B | B |

TABLE 4

| | | Comparative Examples | | | |
|---|---|---|---|---|---|
| | | 1 | 2 | 3 | 4 |
| Molding Method of Image Bearer Protective Agent | | Compression Molding | Compression Molding | Compression Molding | Compression Molding |
| Image Bearer Protective Agent Supply Member | | Urethane Roller | Urethane Roller | Urethane Roller | Urethane |
| Fatty Acid Metal Salts | Zinc Stearate | 90 | 80 | 90 | 80 |
| | Calcium Stearate | — | — | — | — |
| | Zinc Laurate | — | — | — | — |
| Inorganic Lubricants | Boron Nitride A (Tap Density: 0.2 g/cm$^3$) | 10 | 20 | — | — |
| | Boron Nitride B (Tap Density: 0.3 g/cm$^3$) | — | — | — | — |
| | Boron Nitride C (Tap Density: 0.5 g/cm$^3$) | — | — | — | — |
| | Boron Nitride D (Tap Density: 0.6 g/cm$^3$) | — | — | — | — |
| | Boron Nitride E (Tap Density: 0.8 g/cm$^3$) | — | — | — | — |
| | Boron Nitride F (Tap Density: 0.9 g/cm$^3$) | — | — | 10 | 20 |
| Mass Ratio (Fatty Acid Metal Salt/Inorganic Lubricant) | | 90/10 | 80/20 | 90/10 | 80/20 |
| Density of Image Bearer Protective Agent (g/cm$^3$) | | 1.191 | 1.192 | 1.095 | 1.104 |
| Evaluation Results | Charger Contamination Prevention Performance | C | C | B | C |
| | Image Bearer Protection Performance | C | C | C | D |
| | Cleaning Ability | D | D | C | C |
| | Moldability | D | C | B | B |

Details of the fatty acid metal salts and inorganic lubricants listed in Tables 1-4 are as follows.

Fatty Acid Metal Salts

Zinc Stearate: A product of Wako Pure Chemical Industries, Ltd.

Calcium Stearate: A product of Wako Pure Chemical Industries, Ltd.

Zinc Laurate: A product of Wako Pure Chemical Industries, Ltd.

Inorganic Lubricants

Boron Nitride A: PCTP2 available from Saint-Gobain K.K., having a tap density of 0.2 g/cm$^3$.

Boron Nitride B: HP-2W available from Mizushima Ferroalloy Co., Ltd., having a tap density of 0.3 g/cm$^3$.

Boron Nitride C: PCTP8 available from Saint-Gobain K.K., having a tap density of 0.5 g/cm$^3$.

Boron Nitride D: PCTL30 available from Saint-Gobain K.K., having a tap density of 0.6 g/cm$^3$.

Boron Nitride E: HP-1CAW available from Mizushima Ferroalloy Co., Ltd., having a tap density of 0.8 g/cm$^3$.

Boron Nitride F: HP-40 available from Mizushima Ferroalloy Co., Ltd., having a tap density of 0.9 g/cm$^3$.

Examples 16-25 and 28-29 and Comparative Examples 5-7

Image bearer protective agents of Examples 16-25 and 28-29 and Comparative Examples 5-7 were each prepared in the same manner as Example 1 except for changing the types and contents of the fatty acid metal salt and inorganic lubricant and the molding method of protective agent according to the descriptions in Tables 5-8. In addition, in Example 25, the urethane roller mounted on the image forming apparatus used in Example 1 was replaced with a brush roller (product name: SA-7 (acrylic), available from Toray Industries, Inc.). Tap density of each image bearer protective agent was measured in the same manner as Example 1. The measurement results are listed in Tables 5-8.

Example 26

An image bearer protective agent of Examples 26 was prepared in the same manner as Example 14 except for changing the types and contents of the fatty acid metal salt and inorganic lubricant and the molding method of protective agent according to the descriptions in Table 7.

In Example 26, this image bearer protective agent was mounted on the image forming apparatus used in Example 14 in the same manner as Example 14.

Example 27

An image bearer protective agent of Examples 27 was prepared in the same manner as Example 26 except for changing the types and contents of the fatty acid metal salt and inorganic lubricant and the molding method of protective agent according to the descriptions in Table 7.

In Example 26, the urethane roller mounted on the image forming apparatus used in Example 27 was replaced with a brush roller (product name: SA-7 (acrylic), available from Toray Industries, Inc.).

Charger contamination prevention performance, image bearer protection performance, cleaning ability, and moldability of each image bearer protective agent were evaluated using the above image forming apparatus in the same manner as Example 1. In addition, blade squeaking resistance was also evaluated in the following manner. The evaluation results are listed in Tables 5-8.

Blade Squeaking Resistance

An A4-size test chart having an image area ratio of 5% was printed on 10,000 sheets while setting the linear speed of the photoconductor to a full speed (i.e., normal printing speed), and on another 10,000 sheets while setting the linear speed of the photoconductor to a half speed (i.e., thick paper printing speed). Blade squeaking resistance was evaluated based on the following criteria.

Evaluation Criteria

A: No abnormal noise was generated.

B: A slight abnormal noise, which was hard to hear unless one's ear was brought close thereto, was generated in the half speed mode once per 1,000 sheets of printing.

C: An abnormal noise was generated in the half speed mode.

D: An abnormal noised was generated in either the full speed mode or the half speed mode.

TABLE 5

| | | | Examples | | | | |
|---|---|---|---|---|---|---|---|
| | | | 16 | 17 | 18 | 19 | 20 |
| Molding Method of Image Bearer Protective Agent | | | Compression Molding | Compression Molding | Compression Molding | Compression Molding | Compression Molding |
| Image Bearer Protective Agent Supply Member | | | Urethane Roller | Urethane Roller | Urethane Roller | Urethane Roller | Urethane Roller |
| Fatty Acid Metal Salts | | Zinc Stearate | 80 | 80 | 80 | 80 | 80 |
| | | Calcium Stearate | — | — | — | — | — |
| | | Zinc Laurate | — | — | — | — | — |
| Inorganic Lubricants | Second Inroganic Lubricants | Boron Nitride F (Tap Density: 0.12 g/cm$^3$) | — | — | — | — | — |
| | | Boron Nitride A (Tap Density: 0.2 g/cm$^3$) | 10 | 10 | 10 | 10 | 10 |
| | | Boron Nitride G (Tap Density: 0.25 g/cm$^3$) | — | — | — | — | — |
| | | Mica (Tap Density: 0.25 g/cm$^3$) | — | — | — | — | — |
| | First Inorganic Lubricants | Boron Nitride B (Tap Density: 0.3 g/cm$^3$) | 10 | — | — | — | — |
| | | Boron Nitride H (Tap Density: 0.4 g/cm$^3$) | — | 10 | — | — | — |
| | | Boron Nitride C (Tap Density: 0.5 g/cm$^3$) | — | — | 10 | — | — |
| | | Boron Nitride D (Tap Density: 0.6 g/cm$^3$) | — | — | — | 10 | — |
| | | Boron Nitride E (Tap Density: 0.8 g/cm$^3$) | — | — | — | — | 10 |
| Mass Ratio (Fatty Acid Metal Salt/Inorganic Lubricant) | | | 80/20 | 80/20 | 80/20 | 80/20 | 80/20 |
| Density of Image Bearer Protective Agent (g/cm$^3$) | | | 1.186 | 1.180 | 1.174 | 1.167 | 1.154 |
| Evaluation Results | | Charger Contamination Prevention Performance | B | A | A | A | A |
| | | Image Bearer Protection Performance | A | A | A | A | A |
| | | Cleaning Ability | B | A | A | A | A |
| | | Moldability | A | A | A | A | A |
| | | Blade Squeaking Resistance | A | A | A | A | A |

TABLE 6

| | | | Examples | | | | |
|---|---|---|---|---|---|---|---|
| | | | 21 | 22 | 23 | 24 | 25 |
| Molding Method of Image Bearer Protective Agent | | | Compression Molding | Compression Molding | Compression Molding | Compression Molding | Compression Molding |
| Image Bearer Protective Agent Supply Member | | | Urethane Roller | Urethane Roller | Urethane Roller | Urethane Roller | Brush Roller |
| Fatty Acid Metal Salts | | Zinc Stearate | 80 | 80 | — | — | 80 |
| | | Calcium Stearate | — | — | 80 | — | — |
| | | Zinc Laurate | — | — | — | 80 | — |
| Inorganic Lubricants | Second Inroganic Lubricants | Boron Nitride F (Tap Density: 0.12 g/cm$^3$) | — | — | — | — | — |
| | | Boron Nitride A (Tap Density: 0.2 g/cm$^3$) | — | — | — | — | — |
| | | Boron Nitride G (Tap Density: 0.25 g/cm$^3$) | 10 | — | 10 | 10 | 10 |
| | | Mica (Tap Density: 0.25 g/cm$^3$) | — | 10 | — | — | — |
| | First Inorganic Lubricants | Boron Nitride B (Tap Densiy: 0.3 g/cm$^3$) | — | — | — | — | — |
| | | Boron Nitride H (Tap Density: 0.4 g/cm$^3$) | 10 | 10 | 10 | 10 | 10 |
| | | Boron Nitride C (Tap Density: 0.5 g/cm$^3$) | — | — | — | — | — |

TABLE 6-continued

| | | Examples | | | | |
|---|---|---|---|---|---|---|
| | | 21 | 22 | 23 | 24 | 25 |
| | Boron Nitride D (Tap Density: 0.6 g/cm$^3$) | — | — | — | — | — |
| | Boron Nitride E (Tap Density: 0.8 g/cm$^3$) | — | — | — | — | — |
| Mass Ratio (Fatty Acid Metal Salt/Inorganic Lubricant) | | 80/20 | 80/20 | 80/20 | 80/20 | 80/20 |
| Density of Image Bearer Protective Agent (g/cm$^3$) | | 1.177 | 1.177 | 1.177 | 1.177 | 1.177 |
| Evaluation Results | Charger Contamination Prevention Performance | A | A | A | A | A |
| | Image Bearer Protection Performance | A | A | B | B | B |
| | Cleaning Ability | A | A | B | B | B |
| | Moldability | A | A | A | A | A |
| | Blade Squeaking Resistance | A | A | A | A | A |

TABLE 7

| | | | Examples | | | |
|---|---|---|---|---|---|---|
| | | | 26 | 27 | 28 | 29 |
| Molding Method of Image Bearer Protective Agent | | | Melt Molding | Melt Molding | Compression Molding | Compression Molding |
| Image Bearer Protective Agent Supply Member | | | Urethane Roller | Brush Roller | Urethane Roller | Urethane Roller |
| Fatty Acid Metal Salts | | Zinc Stearate | 80 | 80 | 80 | 80 |
| | | Calcium Stearate | — | — | — | — |
| | | Zinc Laurate | — | — | — | — |
| Inorganic Lubricants | Second Inroganic Lubricants | Boron Nitride F (Tap Density: 0.12 g/cm$^3$) | — | — | — | 10 |
| | | Boron Nitride A (Tap Density: 0.2 g/cm$^3$) | — | — | — | — |
| | | Boron Nitride G (Tap Density: 0.25 g/cm$^3$) | 10 | 10 | — | — |
| | | Mica (Tap Density: 0.25 g/cm$^3$) | — | — | — | — |
| | First Inorganic Lubricants | Boron Nitride B (Tap Density: 0.3 g/cm$^3$) | — | — | — | — |
| | | Boron Nitride H (Tap Density: 0.4 g/cm$^3$) | 10 | 10 | 20 | 10 |
| | | Boron Nitride C (Tap Density: 0.5 g/cm$^3$) | — | — | — | — |
| | | Boron Nitride D (Tap Density: 0.6 g/cm$^3$) | — | — | — | — |
| | | Boron Nitride E (Tap Density: 0.8 g/cm$^3$) | — | — | — | — |
| Mass Ratio (Fatty Acid Metal Salt/Inorganic Lubricant) | | | 80/20 | 80/20 | 80/20 | 80/20 |
| Density of Image Bearer Protective Agent (g/cm$^3$) | | | 1.177 | 1.177 | 1.167 | 1.185 |
| Evaluation Results | | Charger Contamination Prevention Performance | A | A | B | B |
| | | Image Bearer Protection Performance | B | B | A | B |
| | | Cleaning Ability | B | B | B | B |
| | | Moldability | A | A | A | A |
| | | Blade Squeaking Resistance | A | A | D | D |

TABLE 8

| | | | Comparative Examples | | |
|---|---|---|---|---|---|
| | | | 5 | 6 | 7 |
| Molding Method of Image Bearer Protective Agent | | | Compression Molding | Compression Molding | Compression Molding |
| Image Bearer Protective Agent Supply Member | | | Urethane Roller | Urethane Roller | Urethane Roller |
| Fatty Acid Metal Salts | | Zinc Stearate | 80 | 80 | 80 |
| | | Calcium Stearate | — | — | — |
| | | Zinc Laurate | — | — | — |
| Inorganic Lubricants | Second Inroganic Lubricants | Boron Nitride F (Tap Density: 0.12 g/cm$^3$) | — | 10 | — |
| | | Boron Nitride A (Tap Density: 0.2 g/cm$^3$) | 10 | — | — |
| | | Boron Nitride G (Tap Density: 0.25 g/cm$^3$) | — | — | 20 |
| | | Mica (Tap Density: 0.25 g/cm$^3$) | — | — | — |
| | First Inorganic Lubricants | Boron Nitride B (Tap Density: 0.3 g/cm$^3$) | — | — | — |
| | | Boron Nitride H (Tap Density: 0.4 g/cm$^3$) | — | — | — |
| | | Boron Nitride C (Tap Density: 0.5 g/cm$^3$) | — | — | — |
| | | Boron Nitride D (Tap Density: 0.6 g/cm$^3$) | — | — | — |
| | | Boron Nitride E (Tap Density: 0.8 g/cm$^3$) | — | — | — |
| | | Boron Nitride I (Tap Density: 0.9 g/cm$^3$) | 10 | 10 | — |
| Mass Ratio (Fatty Acid Metal Salt/Inorganic Lubricant) | | | 80/20 | 80/20 | 80/20 |
| Density of Image Bearer Protective Agent (g/cm$^3$) | | | 1.148 | 1.153 | 1.186 |

TABLE 8-continued

| | | Comparative Examples | | |
|---|---|---|---|---|
| | | 5 | 6 | 7 |
| Evaluation Results | Charger Contamination Prevention Performance | C | C | C |
| | Image Bearer Protection Performance | B | C | A |
| | Cleaning Ability | C | D | D |
| | Moldability | B | B | B |
| | Blade Squeaking Resistance | B | A | A |

Details of the fatty acid metal salts and inorganic lubricants listed in Tables 5-8 are as follows.

Fatty Acid Metal Salts

Zinc Stearate: A product of Wako Pure Chemical Industries, Ltd.

Calcium Stearate: A product of Wako Pure Chemical Industries, Ltd.

Zinc Laurate: A product of Wako Pure Chemical Industries, Ltd.

Inorganic Lubricants

Boron Nitride F: NX1 available from Momentive Performance Materials Inc., having a tap density of 0.12 g/cm$^3$.

Boron Nitride A: PCTP2 available from Saint-Gobain K.K., having a tap density of 0.2 g/cm$^3$.

Boron Nitride G: HP-P1 available from Mizushima Ferroalloy Co., Ltd., having a tap density of 0.25 g/cm$^3$.

Mica: Y-3000 available from YAMAGUCHI MICA CO., LTD., having a tap density of 0.25 g/cm$^3$.

Boron Nitride B: HP-2W available from Mizushima Ferroalloy Co., Ltd., having a tap density of 0.3 g/cm$^3$.

Boron Nitride H: HP-4W available from Mizushima Ferroalloy Co., Ltd., having a tap density of 0.4 g/cm$^3$ Boron Nitride C: PCTP8 available from Saint-Gobain K.K., having a tap density of 0.5 g/cm$^3$.

Boron Nitride D: PCTL30 available from Saint-Gobain K.K., having a tap density of 0.6 g/cm$^3$ Boron Nitride E: HP-1CAW available from Mizushima Ferroalloy Co., Ltd., having a tap density of 0.8 g/cm$^3$.

Boron Nitride I: HP-40 available from Mizushima Ferroalloy Co., Ltd., having a tap density of 0.9 g/cm$^3$.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image bearer protective agent comprising:

a fatty acid metal salt; and an inorganic lubricant including a first inorganic lubricant having a tap density of from 0.30 to 0.8 g/cm$^2$.

2. The image bearer protective agent of claim 1, wherein the inorganic lubricant further includes a second inorganic lubricant having a tap density of 0.25 g/cm$^2$ or less.

3. The image bearer protective agent of claim 2, wherein the second inorganic lubricant includes at least one member selected from the group consisting of mica, boron nitride, molybdenum disulfide, tungsten disulfide, talc, kaolin, montmorillonite, calcium fluoride, silica, graphite, polymethyl methacrylate resin, polytetrafluoroethylene resin, melamine formaldehyde, organic molybdenum, and silicone resin.

4. The image bearer protective agent of claim 1, wherein the first inorganic lubricant includes boron nitride.

5. The image bearer protective agent of claim 1, wherein the fatty acid metal salt includes at least one member selected from the group consisting of zinc stearate, calcium stearate, and zinc laurate.

6. The image bearer protective agent of claim 1, wherein the image bearer protective agent has a density of from 1.11 to 1.190 g/cm$^3$.

7. The image bearer protective agent of claim 1, wherein a mass ratio of the fatty acid metal salt to the inorganic lubricant ranges from 70/30 to 98/2.

8. The image bearer protective agent of claim 1, wherein the image bearer protective agent is a compression-molded product of a mixture of the fatty acid metal salt and the inorganic lubricant.

9. A protective layer forming device comprising:

the image bearer protective agent of claim 1; and an image bearer protective agent supply member to supply the image bearer protective agent onto a surface of an image bearer.

10. The protective layer forming device of claim 9, wherein the image bearer protective agent supply member has a foam layer.

11. The protective layer forming device of claim 10, wherein the foam layer is an open-cell layer.

12. The protective layer forming device of claim 9, further comprising:

a protective layer forming member to press the image bearer protective agent supplied onto the surface of the image bearer against the surface, to form the image bearer protective agent into a protective layer on the surface.

13. An image forming apparatus comprising:

an image bearer;

an electrostatic latent image forming device to form an electrostatic latent image on the image bearer;

a developing device to develop the electrostatic latent image with toner to form a visible image;

a transfer device to transfer the visible image onto a recording medium; and the protective layer forming device of claim 9 to supply the image bearer protective agent onto a surface of the image bearer after the visible image has been transferred therefrom, to form the image bearer protective agent into a protective layer.

14. The image forming apparatus of claim 13, further comprising a cleaner disposed downstream from the transfer device and upstream from the protective layer forming device, to remove residual toner particles remaining on the surface of the image bearer.

15. A process cartridge comprising:

an image bearer; and the protective layer forming device of claim 9 to supply the image bearer protective agent onto a surface of the image bearer and form the image bearer protective agent into a protective layer.

16. An image forming method comprising:

forming an electrostatic latent image on an image bearer;

developing the electrostatic latent image with toner to form a visible image;

transferring the visible image onto a recording medium;

supplying the image bearer protective agent of claim 1 onto a surface of the image bearer after the visible image has been transferred therefrom; and forming the image bearer protective agent into a protective layer.

* * * * *